United States Patent [19]

Eto et al.

[11] 4,041,348

[45] Aug. 9, 1977

[54] MULTI-FIGURE FLUORESCENT DISPLAY TUBE WITH ELECTRICAL LEAD-INS HAVING INNER SPRING CONTACT PORTIONS

[75] Inventors: Goro Eto; Yukihiko Utamura, both of Mobara, Japan

[73] Assignee: Futaba Denshi Kogyo K. K., Chiba, Japan

[21] Appl. No.: 711,577

[22] Filed: Aug. 4, 1976

Related U.S. Application Data

[62] Division of Ser. No. 657,590. Feb. 12, 1976.

[30] Foreign Application Priority Data

Feb. 13, 1975 Japan ..... 50-017476

[51] Int. Cl.[2] ..... H01J 1/72; H01J 63/02

[52] U.S. Cl. ..... 313/497; 313/517; 313/318; 313/331

[58] Field of Search ..... 313/496, 497, 495, 513, 313/331, 332, 517, 318; 174/52 FP

[56] References Cited

U.S. PATENT DOCUMENTS 3,327,153 6/1967 Bickmire et al. ..... 313/517 X 3,381,080 4/1968 Stelmak ..... 174/52 FP

FOREIGN PATENT DOCUMENTS 2,348,186 4/1974 Germany ..... 313/497

*Primary Examiner*—Palmer C. Demeo

*Attorney, Agent, or Firm*—Oblon, Fisher, Spivak, McClelland & Maier

[57] ABSTRACT

A multi-figure fluorescent display tube includes in the casing a plurality of anode display portions formed of segment electrodes each having a fluorescent material layer thereon, cathodes and control electrodes disposed opposite to the anode display portions, lead-in wires led out in an air-tight manner from the casing and electrically connected to the segment electrodes, the control electrodes and the cathodes, a plurality of conductive sections each connected to adjacent common segment electrodes through a corresponding conductive wiring film, the lead-in wires for the segment electrode terminal each having at the end thereof in the casing a contact with a spring portion, the contact coming in contact with the corresponding conductive section by the action of the spring portion thereby establishing an electrical connection.

1 Claim, 5 Drawing Figures

MULTI-FIGURE FLUORESCENT DISPLAY TUBE WITH ELECTRICAL LEAD-INS HAVING INNER SPRING CONTACT PORTIONS

This is a division, of application Ser. No. 657,590, filed Feb. 12, 1976.

BACKGROND OF THE INVENTION

1. Field of the Invention

The present invention relates to a flat-type multi-figure fluorescent display tube (hereinafter often referred to as a fluorescent display tube) for use in an electronic desk calculator or the like.

2. Description of the Prior Art

The fluorescent tube usually employs fluorescent materials which emits light when electrons emitted from the cathode collide therewith, can obtain a very clear display and therefore is often used in an electronic desk calculator. Such display tubes of various shapes have been commercially marketed.

Recently, thin flat-type display tubes have become prevalent, especially small-sized ones. The conventional small-sized fluorescent display tube generally has a construction which will be described later in detail with reference to the attached drawing.

In the conventional display tube, the electrical connection between the connecting portion of a wiring film and the inside end of the lead-in wire for a segment electrode is usually established using a method which melts and burns conductive frit glass to mechanically fix and electrically connect the above parts. However, such a method which melts and burns conductive frit glass at a high temperature has disadvantages. Since the gases generated when the conductive frit glass is melted and burned have an unfavorable influence on the luminous function of the fluorescent material or the electron emission function of the cathode, there is required an additional and separate process to perform the heating and burning in an atmosphere ensuring the safety of the fluorescent material, cathode, etc. using conductive frit glass which is not melted, deteriorated or adversely influenced at the heating temperature of the subsequent sealing process. Further, the adoption of the above additional heating and burning process at a high temperature increases the possibilities of damaging or deteriorating various parts thereby making it difficult to produce sufficiently good and uniform products and to realize successful mass production and economy.

SUMMARY OF THE INVENTION

Therefore, the present invention contemplates to eliminate the above-mentioned disadvantages of the conventional fluorescent display tube and to provide a new and novel fluorescent display tube and a method of producing the same.

It is an object of the present invention to provide a fluorescent display tube simple in construction, free of deterioration for long time use, and high in reliability and to provide a method of producing the same.

It is another object of the present invention to provide a fluorescent display tube which enables the yield in the production process to increase and enables the yield to be made uniform and high in quality at low cost.

It is still another object of the present invention to provide a method of producing a fluorescent display tube which is extremely simplified and suitable for mass production and can produce uniform and high quality products at low cost.

It is a further object of the present invention to provide a fluorescent display tube which is very thin and compact.

The foregoing and other objects are attained in accordance with one aspect of the present invention through the provision of a multi-figure fluorescent display tube which comprises an anode plate and an upper cover connected to each other through a seal portion and therebetween thereby forming a casing, the anode plate having in a laminated state a substrate made of insulating material at the bottom thereof, a plurality of wiring films coated on the substrate, an insulating film coated on the substrate, a plurality of segment electrodes forming a plurality of anode display portions provided in parallel, a fluorescent material layer provided on each of the segment electrodes, the wiring films electrically connecting respective adjacent common segment electrodes, the insulating film insulating each of the wiring films and segment electrodes, the wiring films each electrically connecting the respective common segment electrodes, a plurality of conductive sections provided on the substrate with each connected to respective common segment electrodes through each of the wiring films, cathodes disposed opposite to the anode display portions, control electrodes disposed between the cathodes and each of the anode display portions, lead-in wires for cathode terminals connected to the cathodes which extend in an air-tight manner through the seal portion of the casing, lead-in wires for the control electrode terminal connected to the control electrodes and extended in an air-tight manner through the seal portion of the casing, a plurality of lead-in wires for the segment electrode terminal extended in an air-tight manner through the seal portion of the casing, a plurality of conductive sections provided on the substrate and connected to the respective adjacent common segment electrodes through the wiring films, each of the lead-in wires for the segment electrode terminal having a contact at the end thereof inside the casing through a spring portion, the contact coming in contact with each of the conductive sections by the action of the spring portion thereby establishing an electrical connection.

According to another aspect of the present invention, there is provided a method of producing a multi-figure fluorescent tube which comprises a first stage comprising forming an anode plate and fixedly coated the upper surface of a substrate made of an insulating material with conductive sections and a plurality of conductive wiring films for connecting segment electrodes to respective conductive sections, fixedly coating the upper surface of the substrate with an insulating film adapted to insulate each wiring film and segment electrode and adapted to connect each conductive section to respective segment electrodes through the wiring film and fixedly coating the upper surface of the insulating film with a plurality of segment electrodes with fluorescent material layers thereon, the segment electrodes constituting anode display portions; a second stage comprising integrally forming a frame, at least a plurality of cathode supports, a plurality of lead-in wires for the cathode terminal connected to the respective cathode supports, a plurality of control electrode supports, a plurality of lead-in wires for the control electrode terminal connected to the respective control electrode supports, and a plurality of lead-in wires each having at the end thereof a contact with a spring portion, fixing a plurality of net-shaped control electrodes to respective control electrode supports, and fixing filament-shaped cathodes to the cathode supports thereby forming an electrode assembly framework; a third stage comprising forming a casing by mounting an upper cover and the electrode assembly framework on the anode plate so that the peripheral portions of the upper cover and the anode plate hold therebetween the respective lead-in wires provided on the electrode assembly framework and so that the contact of each lead-in wire for the segment electrode terminal comes into contact with the corresponding conductive section by the action of the spring portion and hermetically sealing the peripheral portions using a sealing medium; and the fourth stage comprising removing unnecessary portions of the frame, lead-in wires, etc. outside the casing after sealing.

BRIEF DESCRIPTION OF THE DRAWINGS

Other objects, features and advantages of the present invention will be more apparent from the following description with reference to the accompanying drawings in which like reference numerals and characters designate corresponding parts throughout the views and in which.

DETAILED DESCRIPTION OF THE PREFERRED EMBODIMENTS

Figure 1:
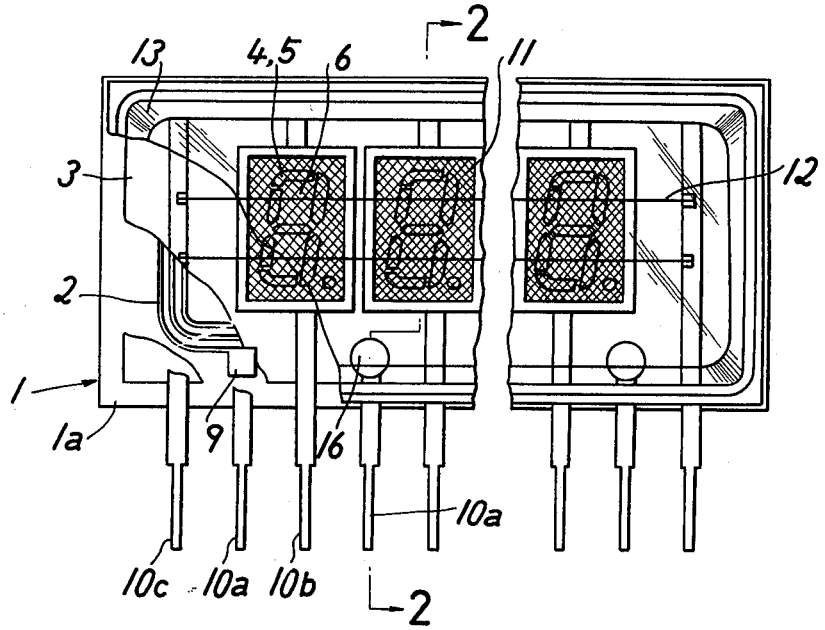
FIG. 1 PRIOR ART
FIG. 1 is a partially cutaway plan view of the essential part of a conventional multi-figure fluorescent display tube, showing an example thereof.
Figure 2:
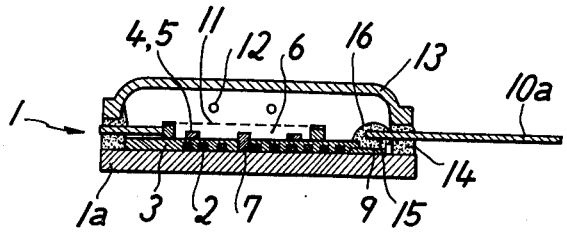
FIG. 2 PRIOR ART
FIG. 2 is a sectional end view taken along line 2—2 of FIG. 1.

Before disclosing the present invention in detail, it will be helpful to describe a typical example of the prior art with a reference to the drawings. FIG. 1 is a partially cutaway plan view of the essential parts of a conventional multi-figure planar display tube and FIG. 2 is a sectional view taken along line 2—2 of FIG. 1. In the drawings, numeral 1 generally designates an anode plate having a substrate 1*a* formed of an insulating material such as glass, on the upper surface of which a plurality of wiring films 2, an insulating layer 3, segment electrodes 4 with fluorescent material layers 5 are laminated. A plurality of the segment electrodes 4 provided with the fluorescent material layers 5 form an anode display portion 6 which displays a pattern such as a figure. A plurality of such anode display portions 6 are arranged in parallel so that a plurality of figures can be selectively displayed. The wiring films 2 are electrically connected adjacent common segment electrodes 4 through a connection hole 7 provided in the insulating film 3. In addition, a connecting portion 9 of the wiring film 2 is connected to a lead-in wire 10*a*. A grid-like control electrode 11 and cathodes 12 are provided opposite to each of the anode display portions 6. The anode plate 1 provided with the anode display portions 6, control electrodes 11, cathodes 12, etc. are covered with an upper cover 13 having an upper transparent peep window made of glass or the like. The upper cover 13 and the anode plate 1 are hermetically sealed at the peripheral sealing portion 14 using a sealing medium such as conductive frit glass to form a casing. A plurality of lead-in wires 10 (10*a*, 10*b* and 10*c*) connected to the segment electrodes 4, control electrodes 11 and cathodes 12, respectively, are led out in an air-tight manner through the sealing portion 14. The portion of each lead-in wire 10, positioned outside the casing, is also used as a terminal to be connected to external equipment.

In the above-mentioned conventional multi-figure display tube, the electrical connection between the connecting portion 9 of the wiring film 2 and the inside end 15 of the lead-in wire 10*a* for segment electrode 4 has been usually established using a method which melts and burns conductive frit glass 16 to mechanically fix and electrically connect the above parts. However, such a method which melts and solidifies conductive frit glass to fix and connect the wiring film 2 and the lead-in wire 10*a* has disadvantages. Since the gases generated when the conductive frit glass is melted and burned have an unfavorable influence on the luminous function of the fluorescent material 5 or on the electron emission function of the cathode 12, there is required previous to and separate from the sealing process for forming the casing using the anode plate 1 and the upper cover 13 an additional process to perform the heating and burning in an atmosphere ensuring the safety of the fluorescent material, cathode, etc. using conductive frit glass 16 which is not melted, deteriorated or adversely influenced at the heating temperature of the sealing process. Further, adoption of the above heating and burning process at a high temperature increases the possibilities of damaging or deteriorating the anode plate 1, various electrodes, etc. thereby making it difficult to produce sufficiently good and uniform products and to realize mass production and good economy.

Now, the present invention will be hereinafter described in detail with reference to FIGS. 3, 4 and 5.

Figure 3:
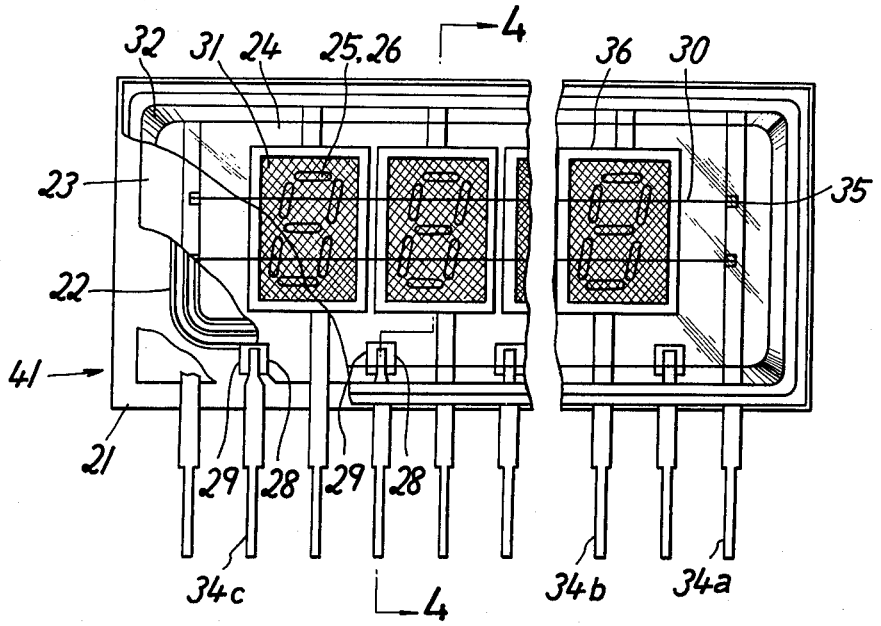
FIG. 3 is a partially cutaway plan view of the essential part of a multi-figure fluorescent display tube according to the present invention, showing an example thereof.
Figure 4:
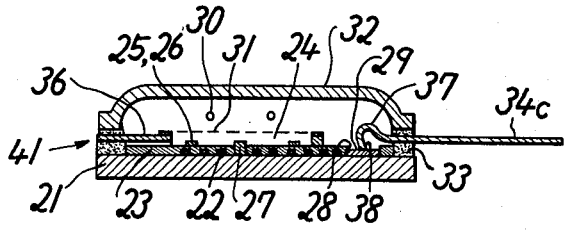
FIg. 4 is a sectional end view taken along line 4—4 of FIG. 3.

FIG. 3 shows a partially cutaway plan view of the essential part of a fluorescent display tube according to the present invention, and FIG. 4 is a sectional view taken along line 4—4 of FIG. 3.

In the drawings, numeral 41 generally designates an anode plate. The anode plate 41 includes a substrate 21 made of an insulating material such as glass and ceramics, a plurality of wiring films 22 coated on the substrate 21, an insulating film 23 coated on the substrate 21, a plurality of segment electrodes 25 forming a plurality of anode display portions 24 provides in parallel, a fluorescent material layer 26 provided on each of the segment electrodes 25, the wiring films 22 electrically connecting respective adjacent common segment electrodes 25, and the insulating film 23 insulating each wiring film 22 and segment electrode 25. The above-mentioned wiring films 22, insulating film 23, segment electrodes 25 and fluorescent material layers 26 are coated in a laminated state. The respective wiring films 22 electrically connect the respective common segment electrodes 25 through connecting holes 27 provided in the insulating film 23 and, in addition, extend to a plurality of conductive sections 29 provided at openings 28 of the insulating film 23 for establishing connection with lead-in wires 34*c*.

Numeral 30 designates cathodes formed of filament-shaped cores made of a high melting point metal such as tungsten and coated with oxides of alkaline earth metals having good thermionic emission efficiency. Cathodes 30 are disposed opposite to the anode display portions 24. Control electrodes 31 are disposed between the cathodes 30 and the respective anode display portions 24 to accelerate and control thermions emitted from the cathodes 30. Numeral 32 designates an upper cover having a transparent peep window made of glass or the like at the portion thereof opposite to the anode display portions 24. The upper cover 32 is hermetically sealed to the substrate 21 at the peripheral portion 33 thereof using a sealing medium such as low melting point frit glass to form a casing.

The cathodes 30 are supported on cathode supports 35 to form a cathode terminal connected to lead-in wires 34*a* which are extended in air-tight manner through the sealed portion 33 between the substrate 21 and the upper cover 32. The control electrodes 31 are supported on a plurality of control electrode supports 36 to form a control electrode terminal connected to a plurality of lead-in wires 34*b* extended in an air-tight manner through the sealed portion 33, respectively.

A plurality of lead-in wires 34*c* for a segment electrode terminal are extended in an air-tight manner through the seal portion 33. The portion of each lead-in wire 34*c* inside the seal portion 33 has a contact 38 provided through a spring portion 37. The contact 38 is pressed against each conductive section 29 connected to each segment electrode 25 through the wiring film 22 by the action of the spring portion 37 to thereby establish an electrical connection. The above-mentioned spring portion 37 and contact 38 may be formed integrally with the lead-in wire 34*c* itself utilizing the resilient force thereof, or may be formed of a suitable resilient material such as stainless steel plate and Fe—Ni alloy plate which is connected to the lead-in wire 34*c* by spot welding or the like.

The conductive section 29 on the substrate 21 in contact with contact 38 may utilize an extension of the wiring film 22 without an additional coating, or may be coated with an additional conductive film made of a material having a good appearance and which is stable for fluorescent material or for electron-emitting coating material on the cathode surface, such as graphite, black or gray conductive metal and metal oxide. Such additional coating can make the product more stable and higher in quality in terms of appearance and performance.

As is apparent from the above-mentioned example, the fluorescent display tube according to the present invention establishes an electrical connection between a plurality of segment electrodes and each lead-in wire therefor extended through the sealed portion by using a very simple and realiable construction in which pressure contact is made in a vacuum by a spring force. Therefore, stable performance free of deterioration for a long time is realized. If such a tube is produced according to the following method, additional excellent effects will be obtained.

Now the method of producing a fluorescent display tube according to the present invention will be hereinafter described in detail in conjunction with FIG. 5.

Figure 5:
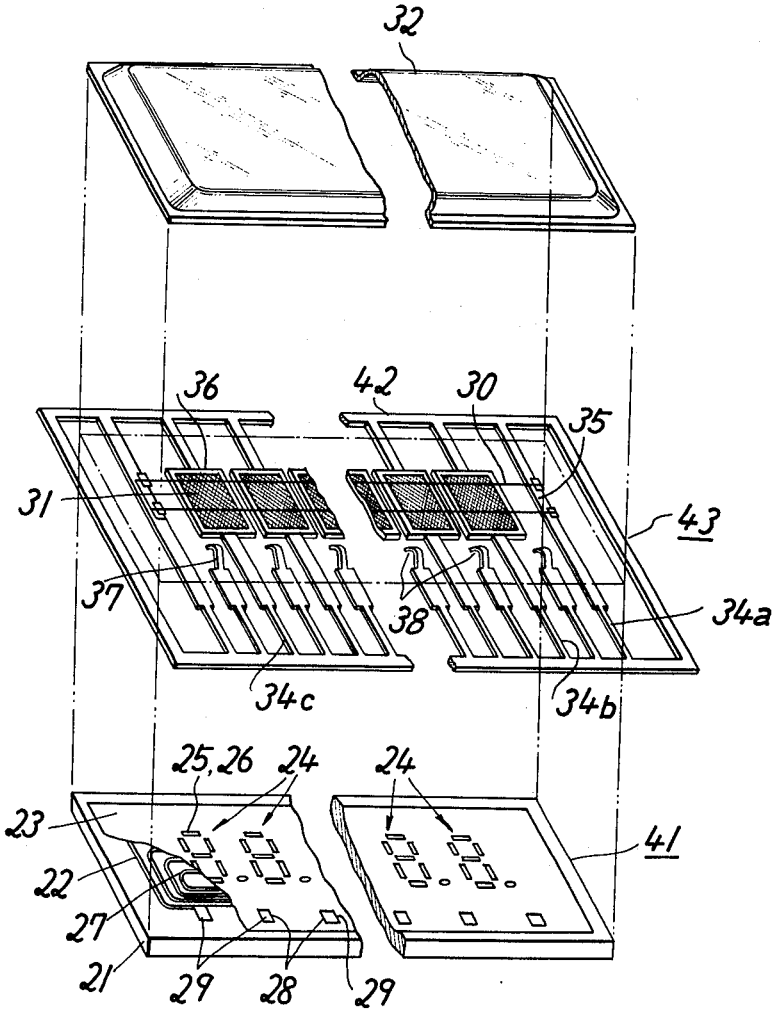
FIG. 5 is an exploded perspective view of a fluorescent display tube according to the present invention, showing an example of producing the same.

FIG. 5 is a perspective exploded view of the essential part of a fluorescent display tube of the present invention, showing the method of producing the same.

As shown in FIG. 5, the method of producing a fluorescent display tube according to the present invention comprises a first stage for forming an anode plate 41, a second stage for forming an electrode assembly framework 43, a third stage for forming a casing by sealing, a fourth stage for removing unnecessary parts after sealing, and a fifth stage including conventional air-exhausting and ageing steps.

The above-mentioned first stage has the steps of fixedly coating the upper surface of a substrate 21 made of an insulating material such as glass and ceramics with conductive sections 29 and a plurality of wiring films 22 for connecting segment electrodes 25 to the respective conductive sections 29, laminatedly and fixedly coating the upper surface of the substrate 21 with an insulating film 23 which insulates each wiring film 22 and segment electrode 25 and has connecting holes 27 for connecting each segment electrode 25 to a corresponding wiring film 22 and also has openings 28 for the conductive sections 29, and laminatedly and fixedly coating the upper surface of the insulating film 23 with a plurality of segment electrodes 25 and fluorescent material layers 26 in this order so that each segment electrode 25 may be connected to the corresponding wiring film 22 through the connecting hole 27, the segment electrodes 25 constituting each anode display portion 24.

The above-mentioned second stage has the steps of integrally forming a frame 42, at least a plurality of cathode supports 35, a plurality of lead-in wires 34*a* for a cathode terminal connected to the respective cathode supports 35, a plurality of control electrode supports 36, a plurality of lead-in wires 34*b* for a control electrode terminal connected to the respective control electrode supports 36, and a plurality of lead-in wires 34*c* each having at the end thereof a contact 38 with a spring portion 37; fixing a plurality of net-shaped control electrodes 31 to the respective control electrode supports 36; and fixing filament-shaped cathodes 30 coated with a material high in electron emissivity to the cathode supports 35.

The above-mentioned third stage has the steps of mounting the electrode assembly framework 43 on the anode plate 41 so that each opposing anode display portion 24 and the control electrode 31 may be mated and so that the contact 38 of each lead-in wire 34*c* for the segment electrode terminal comes into contact with the corresponding conductive section 29 by the action of the spring portion 37, mounting on the electrode assembly framework 43 an upper cover having a transparent peep window made of a material such as glass at least on the upper surface thereof so that the peripheral portions of the upper cover 32 and the anode plate 41 hold therebetween the respective lead-in wires provided on the electrode assembly framework 43, and sealing the above peripheral portions using a sealing medium such as a low melting point frit glass.

The above-mentioned fourth stage has the steps of removing unnecessary portions of the frame 42, lead in wires, etc. outside the casing after sealing.

The above second and third stages may be carried out in the manner including the steps of integrally forming a frame 42, at least a plurality of cathode supports 35, a plurality of lead-in wires 34*a* for a cathode terminal connected to the respective cathode supports 35, a plurality of control electrode supports 36, a plurality of lead-in wires 34*b* for a control electrode terminal connected to the respective control electrode supports 36, and a plurality of lead-in wires 34*c* each having at the end thereof a contact 38 with a spring portion 37; fixing a plurality of net-shaped control electrodes 31 to the respective control electrode supports 36 thereby forming an intermediate assembly framework; mounting the intermediate assembly framework on the anode plate 41 so that each opposing anode display portion 24 and the control electrode 31 may be mated and so that the contact 38 of each lead-in wire 34c for the segment electrode terminal comes into contact with the corresponding conductive section 29 by the action of the spring portion 37; temporarily fixing the intermediate assembly framework to the anode plate 41 at suitable positions using a suitable adhesive such as glass frit not yet burned; and fixing the cathodes 30 to the intermediate assembly framework thereby forming an electrode assembly framework 43. In this case, an upper cover 32 is placed on the anode plate 41 on the upper surface of which the assembly framework 43 is temporarily fixed, and is hermetically sealed to form a casing.

In the above-mentioned embodiment of the present invention, the substrate 21 on which the anode display portions are disposed is shown as flat, and the upper cover 32 is shown as flat-bottomed boat-shaped. However, it is not necessary to limit the substrate 21 and the upper cover 32 to the above shapes. For instance, both the substrate 21 and the upper cover 32 may be formed flat and a suitable spacer may be placed therebetween; or only the substrate 21 may be formed into a flat-bottomed boat shape; or both the substrate 21 and the upper cover 32 may be formed into a flat-bottomed boat shape; or any other combinations of suitable shpaes are possible.

In the above-mentioned embodiment of the present invention, provision of a getter in the casing was not specifically mentioned. However, it goes without saying that a getter can be disposed at a suitable position in the casing. In the fluorescent display tube according to the present invention, a frame 42 adapted to be equipped with a getter may be used to form an electrode assembly framework 43 provided with a getter. Thus, the provision of a getter in the casing may be quite reasonably effected.

In the above-mentioned embodiment of the present invention, the provision of a usually used exhaust pipe was not specifically mentioned. However, a usually used exhaust pipe may be held at a desired position of the sealing portion to be fixed in the sealing process; or may be previously fixed at a desired position of the substrate 21 or the upper cover 32 using a suitable sealing medium. Sealing between the anode plate 41 and the upper cover 32 may be effected in a high vacuum without an exhaust pipe simultaneously with the air evacuation.

As is apparent from the foregoing description, the fluorescent display tube according to the present invention has the above-mentioned construction and is produced by the above-mentioned method and therefore has the following various features and effects:

1. The electrical connection between each segment electrode and the lead-in wire is made by pressure contact therebetween by the action of spring force. Therefore the tube is simple in construction, can be used for a long time without deterioration and is very high in reliability.
2. In order to form a connection between each segment electrode and lead-in wire, it is not necessary to adopt an intermediate process including high temperature heating and burning which is conventionally carried out when the connection is made using an adhesive such as conductive frit glass and which deteriorates the fluorescent material and the electron emitting coating material on the cathode due to the emission of noxious gases. Therefore, the yield of the production process is improved, and fluorescent display tubes uniform and high in quality can be produced at low cost.
3. The method of producing the fluorescent tube according to the present invention consists of the steps of producing an anode plate utilizing the printing technique; making an electrode assembly framework by integrally forming control electrodes, cathodes and various lead-in wires; and forming a casing by sealing the anode plate, electrode assembly framework and upper cover together. Compared with the conventional method, this method is very much simplified and is suitable for mass-production. Therefore, this method can produce uniform and high quality products at low cost.
4. The fluorescent display tube according to the present invention has a construction in which lead-in wires also used as terminals are directly led out from the casing through the seal portions thereof and in which unnecessary space in the casing is minimized due to the anode display portions being provided directly on the substrate which forms a part of the casing. Therefore, the casing can be made very thin and compact in its entirety. Accordingly, the fluorescent tube according to the present invention is very suitable for use in a portable, handy and small-sized electronic desk calculator.

Obviously, numerous modifications and variations of the present invention are possible in light of the above teachings. It is therefore to be understood that within the scope of the appended claims the invention may be practiced otherwise than as specifically described herein.

What is claimed as new and desired to be secured by letters patent of the United States is:

1. A multi-figure fluorescent display tube comprising:
an anode plate and an upper cover connected to each other through a seal portion therebetween thereby forming a casing,
the anode plate having in a laminated state a substrate made of insulating material at the bottom thereof,
a plurality of wiring films coated on the substrate,
an insulating film coated on the substrate,
a plurality of segment electrodes forming a plurality of anode display portions provided in parallel,
a fluorescent material layer provided on each of the segment electrodes,
the wiring films electrically connected respective adjacent common segment electrodes,
a plurality of conductive sections provided on the substrate with each connecting respective common segment electrodes through the wiring films,
cathodes disposed opposite to the anode display portions,
control electrodes disposed between the cathodes and the anode display portions,
lead-in wires for a cathode terminal connected to the cathodes and extended in an air-tight manner through the seal portion of the casing,
lead-in wires for a control electrode terminal connected to the control electrodes and extended in an air-tight manner through the seal portion of the casing,
a plurality of lead-in wires for the segment electrode terminal extended in an air-tight manner through the seal portion of the casing,
each of the lead-in wires for the segment electrode terminal having a contact at the end thereof inside the casing through a spring portion,
the contact coming in contact with each of the conductive sections by the action of the spring portion thereby establishing an electrical connection.

* * * * *